United States Patent [19]

Pincemy

[11] Patent Number: 4,939,708

[45] Date of Patent: Jul. 3, 1990

[54] TIMEPIECE OF THE ANALOG TYPE

[76] Inventor: Luce R. G. Pincemy, 6 rue Ecole de Droit, 34000 Montpellier, France

[21] Appl. No.: 311,063

[22] Filed: Feb. 16, 1989

[30] Foreign Application Priority Data

Feb. 16, 1988 [FR] France ..... 88 01797

[51] Int. Cl.[5] ..... G04B 19/04

[52] U.S. Cl. ..... 368/233; 368/221

[58] Field of Search ..... 368/233, 238, 221

[56] References Cited

U.S. PATENT DOCUMENTS 2,011,517 8/1935 Geoffron ..... 368/233

FOREIGN PATENT DOCUMENTS 982054 2/1965 United Kingdom ..... 368/238

*Primary Examiner*—Bernard Roskoski

*Attorney, Agent, or Firm*—A. W. Breiner

[57] ABSTRACT

Timepiece of the analog type, in which the hour hands are replaced by two coaxial disks which are split radially and bent helically and which are arranged in such a way that each passes between the leading edge and the trailing edge of the other in the direction of rotation. One disk makes one revolution in twelve hours, the other disk being retained by a stop, then three is an exchange of the disks, and a second thereafter makes one resolution in twelve hours, the first being retained. One edge of each disk thus performs, each in its turn, the function of the hour hand. The mechanism comprises a driver, which is carried by a barrel coaxial relative to the disks and which is axially movable relative to this barrel, and a retaining stop which is preferably movable axially, but without being rotatable.

9 Claims, 3 Drawing Sheets

TIMEPIECE OF THE ANALOG TYPE

BACKGROUND OF THE INVENTION

The present invention relates to a timepiece, such as a clock or watch, of the analog type.

The search for a novel design for timepieces often results in decorative designs in which the height of the hands or the dial marks have become so inconspicuous that it is difficult to tell the time. Moreover, traditional timepieces have an hour hand which makes one revolution in twelve hours, and because it is impossible to distinguish the morning hours from the evening hours persons obliged to move from place to place quickly and cross a large number of time zones can make mistakes.

The object of the invention is to provide a timepiece which, for the sake of simplification, will be called a "clock", even if it is an alarm clock, a carriage clock or a watch, which has a distinctly novel appearance, but is particularly easily readable and which makes it possible to distinguish the two twelve-hour periods making up a day.

To achieve this result, there are already known timepieces of the analog type (U.S. Pat. Nos. 2,011,517; 2,785,530; CH-A-7021/69 and DE-U-87.01135), in which the time display means comprise two coaxial disks which are split radially and bent helically and which are arranged in such a way that each passes between the leading edge and the trailing edge of the other, leading and trailing being defined in relation to the clockwise direction of rotation.

A mechanism causes a first disk to rotate in the clockwise direction, while second is retained by a stop, the rotation continuing over one revolution from he first moment when the two disks are superposed, only one being visible, up to a second moment when the two disks are once again superposed, the only one visible at the start being concealed by the other, at this second moment the mechanism effecting an exchange in which the disk driven until then becomes retained and the disk retained until then becomes driven.

Despite the fact that some of the documents mentioned are relatively old, this system has not yet been developed, probably because of the complication and/or fragility of the mechanisms.

The object of the present invention is to provide a timepiece of the abovementioned type, but in which the mechanism for the drive and exchange of the disks is simpler, more robust and more reliable than what has been provided hitherto.

SUMMARY OF THE INVENTION

To achieve this result, according to the invention the mechanism is provided to comprise a barrel wheel, which is connected to a clockwork mechanism causing it to rotate through one revolution in twelve hours and which is coaxial relative to the disks, and a driver carried by the said barrel wheel, this driver being axially movable relative to the barrel wheel in order to remain bearing on the helical disk which is immobilized while it drives the other disk in rotation, and the means for exchanging the driven and immobilized disks comprising a ramp which moves the said driver axially in order to cause it to leave the disk which it was driving until then and come into contact with the other disk.

Because a rotating driver carried by a barrel wheel coaxial relative to the disks is used, this makes it possible to have a mechanism arranged at the center of the disks and therefore robust and compact.

The helical disks can each form a helix having a right-handed pitch or a left-handed pitch. There a right-handed pitch is concerned, the driven disk, at the start of its rotation, conceals the retained disk and then it progressively reveals it, the trailing edge of he driven disk showing the time. On the contrary, where left-handed pitch is concerned, the driven disk is asked at the start of its rotation, and it is its leading edge which shows the time.

According to an embodiment which is advantageous, because it is very simple, for the exchange the leading ege of each disk is provided so as to be of sufficient thickness to ensure at the leading edge of the driven disk moves the leading edge of the retained disk axially in the direction of the visible face of the display means, in order to cause it to pass over the stop at the moment of exchange of the driven and retained disks, the leading edge of the driven disk then coming to bear against the stop instead of the leading edge of the disk retained until then.

According to a first embodiment, the ramp is stationary relative to the frame of the timepiece.

According to another useful embodiment, there are two ramps, each carried by a disk in the vicinity of its trailing edge, the ramp carried by the retained disk serving for the axial movement of the driver when it reaches this.

According to a preferred embodiment it is provided that:

the means for moving the driver axially consist of the disk which is itself immobilized and on which the said driver slides, the stop is movable axially and is driven axially by the driven disk on which it slides, return means push the driver and the stop against the respective disk on which they slide.

This results in a mechanism of great simplicity, since there is no longer a separate ramp for moving the driver, and there is a gain in reliability because of the movable stop, without having the complication of a ramp for this stop.

Advantageously, the driver is in one piece with the barrel wheel and is connected to the body of this barrel wheel by means of a flexible part, and the stop is in one piece with a sleeve surrounding the barrel wheel with play and fixed to the frame of the timepiece, the stop being connected to the said sleeve by means of a flexible part. The number of components is thus reduced to a minimum: the two disks, the barrel wheel carrying the driver, and the sleeve carrying the stop.

Preferably, each disk has two notches, one for the driver and the other for the stop, the angular deviation between these notches being equal, for each disk, to the angular deviation between the driver and the stop at the moment of exchange between the driven and immobilized disks.

The effect of this arrangement is to prevent an uncontrolled movement of the driven disk under a shock or sudden jolt of the timepiece.

Advantageously, the disks, before being mounted in the timepiece, have a helical form, with a pitch larger than that which they have in the timepiece, and, after mounting, are gripped elastically between a flange carried by the barrel wheel and a stationary surface integral with the frame.

A retention of the disks without play is thereby obtained.

It was stated above that the helical disks could have a right-handed pitch or a left-handed pitch. In the embodiment just described last, it is preferable for the pitch to be left-handed. In fact, in this case, the force exerted on the driver must be counter to the visible face of the timepiece, this being simpler to obtain than a force in the opposite direction.

BRIEF DESCRIPTION OF THE DRAWINGS

The invention will now be described in more detail by means of practical examples illustrated in the drawings in which.

In all the Figures, the same references designate the same elements.

DETAILED DESCRIPTION

Figure 1:
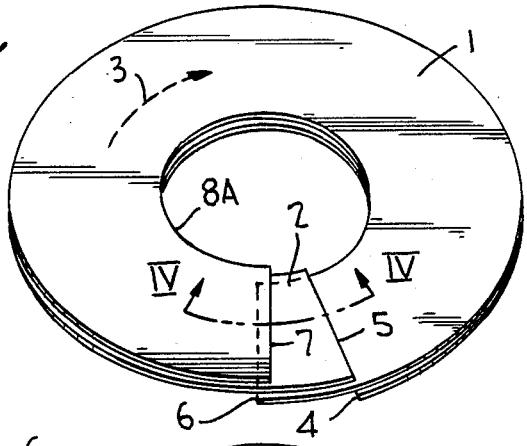
FIG. 1 is a perspective view showing two split disks which are essential elements of the invention and which have a right-handed pitch.

FIG. 1 shows two helical split disks 1, 2 arranged so as to rotate in the clockwise direction symbolized by the arrow 3. The disk 1 passes between the leading edge 4 and the trailing edge 5 of the disk 2, and the disk 2 itself passes between the leading edge 6 and the trailing edge 7 of the disk 1.

It will easily be appreciated that, if the disk 2 is immobile and the disk 1 rotates in the clockwise direction defined by the arrow 3, there will be a moment when its trailing edge 7 comes underneath the trailing edge 5 of the disk 2. If, at that moment, the disk 1 which is completely covered by the disk 2 is immobilized and the disk 2 begins to rotate, the latter will progressively reveal the surface of the disk 1, until its trailing edge 5 in its turn comes underneath the trailing edge 7 of the disk 1, and so on and so forth.

Figure 2:
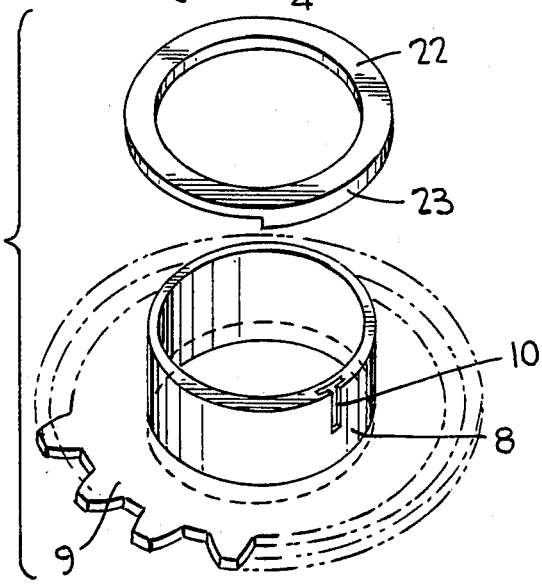
FIG. 2 is an exploded perspective view showing the driving pinion and the barrel wheel.

FIG. 2 shows a barrel 8 similar to that which equips traditional clocks and which carries the hour hand. This barrel is fixed to a toothed pinion 9 connecting it to the clockwork mechanism. The barrel 8 is of such a diameter that it passes without play through a central recess 8A of the disks 1 and 2.

In contrast to a conventional barrel wheel, the barrel 8 has an axial notch 10 with a T-shaped cross-section and open outwards.

Figure 3:
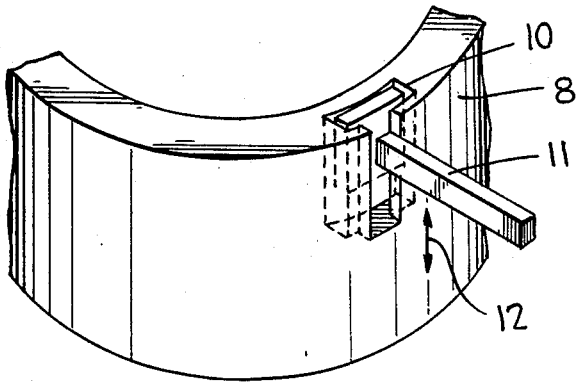
FIG. 3 is a perspective view of the stop-carrier piece.

As shown in FIG. 3, the notch 10 serves for retaining a driver 11 of the disks, which is capable of moving axially in the notch 10 according to the arrow 12. This driver 11 is directed substantially axially, so as to come to bear against the trailing edge 7 or 5 of one of the disks 1 or 2.

Each of the disks 1 or 2, on its edge adjacent to the recess 8A, carries a piece 13, 14 which can be represented as being cut out from a cylinder coaxial relative to the recess 8A. Each of the pieces 13, 14 has a bearing part 15, 16, and the driver 11 has been shown bearing on the bearing surface 15 relating to the disk 1. The piece 13 or 14 also carries a sloping ramp 17, 18. It will be seen that, when the disk 1 has completed one revolution, the driver 11 will encounter the ramp 18 carried by the disk 2, which will cause it to rise above the disk 1 and come into contact with the bearing surface 16 of the disk 2, in order to drive the latter.

Figure 4:
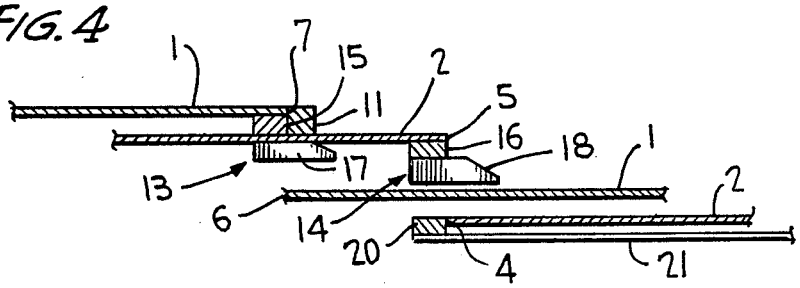
FIG. 4 is a partial section along the line IV—IV of FIG. 1.

FIG. 4 also shows the leading edges 6 and 4 of the disks 1 and 2. The leading edge 4 of the disk 2 bears against a stop 20 carried by a support 21. It can be seen that, when the disk 1 completes its revolution, its leading edge 6 coming under the disk 2 will lift the leading edge 4 of the latter above the stop 20 and assume its position for immobilizing the disk 1.

In the arrangement illustrated, the ramps 17 and 18 are each in turn kept immobilized by means of the stop 20 and the disk 1 or 2, which carries them.

According to another embodiment (not shown), there is only one ramp at the location of the ramp 18 of FIG. 4, and it is stationary and integral with the frame.

A ring 22 which can be seen in FIG. 2 keeps he driver 11 bearing on that disk which is not driven in rotation. This ring is stationary and located at the top of the barrel 8, and on its lower face it has a helical surface 23 matching that of this disk. According to an alternative version, a spring (not shown) pushes the driver 11 against the disk which is not driven.

Figure 5:
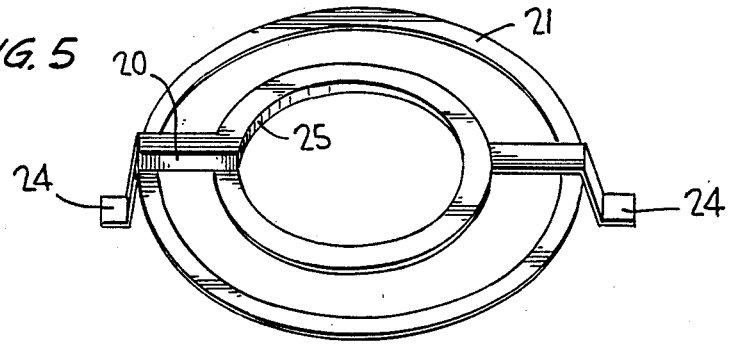
FIG. 5 is a perspective view showing the stop and its support.

FIG. 5 shows the support 21 and the stop 20 agrammatically. This support is formed from a recessed disk equipped with feet 24 for fastening it to a base integral with the frame of the timepiece. It has a central recess 25 for the passage of the barrel 8. Its thickness varies progressively over its inner circumference, so as to compensate the helical form of the disks 1, 2, at least one of which always bears on it.

Figure 6:
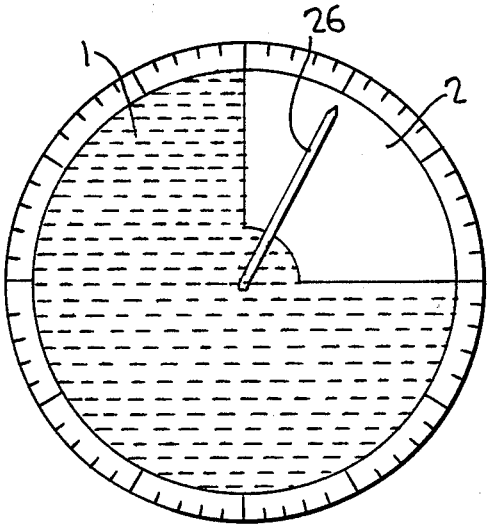
FIGS. 6 and 7 are views showing how to tell the time on the device of the invention.
Figure 7:
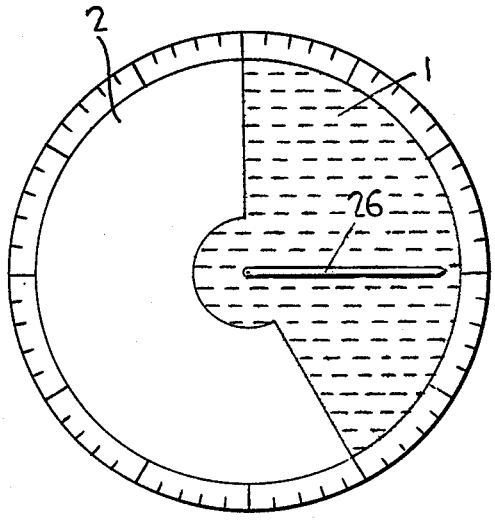

FIGS. 6 and 7 show the appearance of the timepiece according to the invention at three hours five minutes and at seventeen hours fifteen minutes. It can be assumed that, in FIG. 1, three quarters of the disk 2 (white) are masked by the disk 1 (grey), whilst, in FIG. 7, it is the disk 1 that masked over more than half its surface by the disk 2. It has been assumed, in these Figures, that the exchange of the disks 1 and 2 has a disk driven in rotation and as an immobilized disk takes place at midday and at midnight. Of course, another convention can be adopted and it can be assumed that the exchange takes place at six hours and at eighteen hours. In this case, one of the disks will be decorated in a color reminiscent of the day and the other in a color reminiscent of the night, and the disk will appear divided in two half-disks of equal colors at six hours and at eighteen hours.

Of course, other combinations of colors and of forms of disks are possible, without departing from the scope of the invention. In particular, there can be lines which indicate the hours and which are carried directly on each of the disks and not on the graduated circle surrounding the display surface.

As will have been guessed, the reference 26 in FIGS. 6 and 7 denotes the minute hand mounted in the conventional way. If the graduated circle does not serve for indicating the hours, this circle can be graduated directly in minutes.

Figure 8:
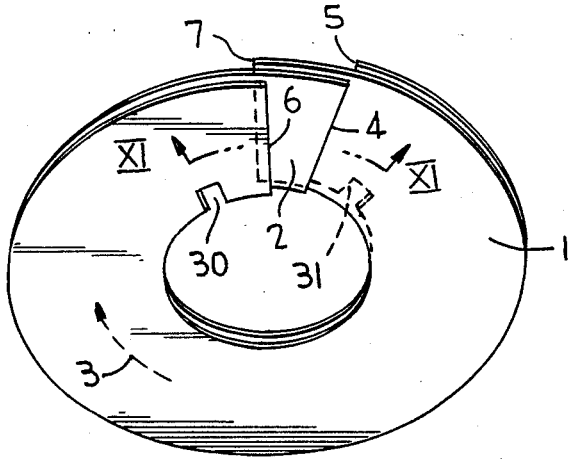
FIG. 8 is a perspective view showing two split disks with a left-handed pitch and notches.

FIG. 8 is similar to FIG. 1, except that the helical disks have a left-handed pitch.

Consequently, now, the leading edge of the driven disk 1, in the direction of the arrow 3, serves for showing the time, here around 11 hours, because the retained disk 2 is masked virtually completely.

A notch 30 is shown, on the disk 1, serving for driving it by means of a driver and, disk 2, a notch 31 serving for retaining it by means of the stop. The disk 1 also carries a retaining notch and the disk 2 a driving notch. They have not been shown. Then the disks 1 and 2 are superposed, their retaining and driving notches coincide with one another.

Figure 9:
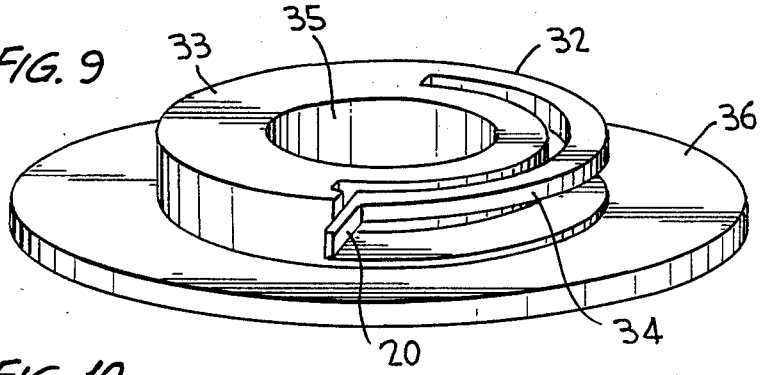
FIG. 9 is a perspective view of a sleeve carrying a movable stop.

FIG. 9 shows the stop-carrier piece 32 consisting of a sleeve 33 which carries the stop 20 by means of a tongue 34 flexible in the axial direction, that is to say vertically in the Figure. In the embodiment illustrated, the stop and tongue are in one piece with the sleeve 33. The sleeve comprises an axial bore 35 of a diameter a little larger than the outside diameter of the barrel 8, as can be seen better in FIG. 10. The sleeve also carries a flange 36 perpendicular relative to the axis and on the side opposite to the stop 20. The flange 36 serves two purposes: on the one hand, it serves for fastening the sleeve to the frame 40 of the timepiece, for example by means of screws 41, and, on the other hand, it keeps the helical disks in place.

Figure 10:
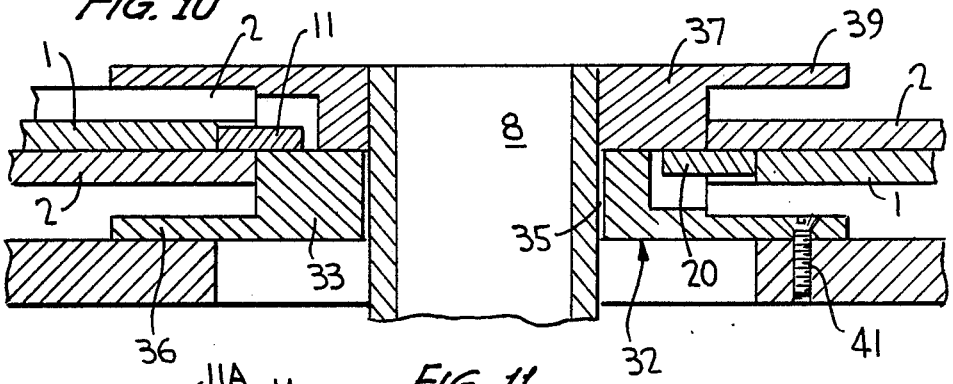
FIG. 10 is a diagrammatic section through the central part of an embodiment different from that of FIGS. 2 to 5.

The piece 37 carrying the driver 11 has not been shown in the same way as the stop-carrier piece 32, and it can only be seen in section in FIG. 10. In the embodiment described, this piece is almost identical to the piece 32. However, its bore 38 is of a smaller diameter, to allow it to be force-fitted on the barrel 8, and its flange 39 can be smaller. In fact, this flange does not serve for fastening the piece, but only for retaining the disks which are gripped lightly between his flange and the flange 36 of the stop-carrier piece. In the timepiece, the driver carrier piece is in a position reversed in relation to the stop-carrier piece, that is to say these two pieces are in contact via their part carrying the stop 20 on the driver 11, whilst their flanges 36, 39 are opposite one another.

FIG. 10 shows he respective positions of the various elements. In his Figure, the driver 11 is shown in section on the left-hand side and the stop 20 on the right-hand side. The situation where these two elements are opposite one another occurs once in each revolution at around 6 hours if the notches 30, 31 are located respectively in the vicinity of the leading and trailing edges of the disks 1, 2.

FIG. 10 also shows how the flange 36 is mounted on the frame 40 by means of screws, one 41 of which is shown.

Figure 11:
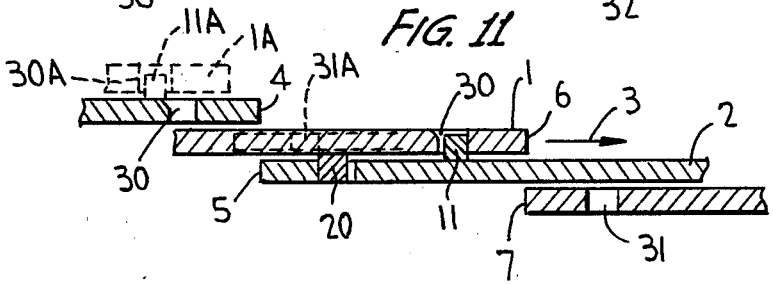
FIG. 11 is a diagrammatic view similar to that of FIG. 4 and illustrating the embodiment of FIGS. 8 to 10.

FIG. 11 is a developed section corresponding to the line XI—XI of FIG. 8. It shows the driver 11 seated in the notch 30 of the driven disk 1 and the stop 20 seated in the notch 30 of the retained disk 2. The driven disk 1 moves according to the arrow 3. Broken lines represent the positions 1A, 30A, 31A of the driven disk 1 and of its driving and retaining notches 30, 31 and of the position 11A of the driver, just before the exchange. It can be seen that the driver is ready to fall (a downward movement in the Figure) into the notch 30 of the retained disk, whilst the stop 20 is ready to enter (a downward movement in the Figure) the notch 31A of the driven disk.

The above timepiece has been described as a device for showing the time. It is clear that it can serve for indicating other data, for example counting articles travelling past.

What is claimed is:

1. An analog timepiece comprising:

(a) first and second coaxial helically bent disk split radially forming a leading edge and a trailing edge in each of said disks, said first and second disks being positioned relative to each other so that each of said disks is rotatable in the same direction in such a manner that the portion of each of said disks intermediate said leading edge and said trailing edge passes between said leading edge and said trailing edge of the other of said disks;

(b) a barrel wheel positioned coaxially in relation to said first and second disks and said barrel wheel being connected to a clockwork mechanism which rotates said barrel wheel one revolution in a twelve hour period;

(c) driving means projecting from said barrel wheel and being axially movable along said barrel wheel so that said driving means initially bears on said first disk while simultaneously driving said second disk in rotation due to said rotation of said barrel wheel by said clockwork mechanism;

(d) means for moving said driving means axially to cause said driving means to bear on said first disk until said first disk and said second disk become superposed at which time said means for moving said driving means causes said driving means to bear on said second disk and to drive said first disk;

(e) stop means for retaining said first disk in a stationary position during said rotation of said second disk by said driving means and for retaining said second disk in a stationary position during said rotation of said first disk; and (f) means for repositioning said stop means when said first and second disks are superposed so that said stop means retains said second disk in a stationary position during said rotation of said first disk or retains said first disk in a stationary position during said rotation of said second disk.

2. The analog timepiece according to claim 1 wherein said leading edge of each of said first and second disks has a thickness sufficient to (a) move said leading edge of said disk being driven by said driving means axially to said leading edge of said disk retained in a stationary position by said stop means, and (b) move said leading edge of said disk being driven past said stop means when said first and second disks become superposed.

3. The analog timepiece according to claim 2 wherein said means for moving said driving means axially is provided by a stationary ramp.

4. The analog timepiece according to claim 2 wherein said means for moving said driving means axially when said first and second disks are superposed is a first and second ramp wherein one ramp is present in the area of each of said trailing edge of said first and second disks.

5. The analog timepiece according to claim 1 wherein:

(a) said driving means is constructed and arranged to slip on said disk being held stationary by said stop means as said driving means is being moved axially upon said rotation of said barrel wheel;

(b) said stop means is constructed and arranged to slip on said disk being driven by said driving means and is axially moved thereby, and (c) said driving means and said stop means are caused to bear against said first disk or said second disk by stationary support means.

6. The analog timepiece according to claim 5 wherein (a) said driving means is flexibly connected to said barrel wheel, and (b) said stop means is flexibly connected to a stationary sleeve which is coaxial to said barrel wheel.

7. The analog timepiece according to claim 5 wherein each of said first and second disks have a first and second notch formed therein for receiving said driving means and said stop means, wherein the angular spacing between said first and second notches of said first disk and said first and second notches of said second disk are equal to the angular spacing present between said driving means and said stop means when said first and second disks are superposed.

8. The analog timepiece according to claim 5 wherein said first and second disks are movably held between a first and second flange in a manner whereby the pitch of said helically bent first and second disks is compressed, said first and second flanges being coaxial to said barrel wheel and said second flange being stationary and connected to a frame.

9. The analog timepiece according to claim 5 wherein said helically bent first and second disks have a left-handed pitch.

* * * * *